United States Patent [19]

Todd

[11] Patent Number: 4,810,539

[45] Date of Patent: Mar. 7, 1989

[54] EARTH ART FORMS

[76] Inventor: David B. Todd, 3204 Riva Ridge, Austin, Tex. 78746

[21] Appl. No.: 96,620

[22] Filed: Sep. 14, 1987

[51] Int. Cl.[4] ..... A44C 21/00

[52] U.S. Cl. ..... 428/7; 428/13; 428/28; 428/64; 428/539.5; 428/542.2; 40/27.5

[58] Field of Search ..... 428/17, 7, 27, 23, 28, 428/539.5, 542.2; 523/440, 443, 446; 63/2, 1 R, 23; 40/27.5

[56] References Cited

U.S. PATENT DOCUMENTS

| | | | |
|---|---|---|---|
| 3,955,934 | 5/1976 | Tizzi | 63/2 |
| 3,997,686 | 12/1976 | McClure | 63/2 |
| 4,142,383 | 3/1979 | Eberhart | 63/23 |
| 4,361,661 | 11/1982 | Jackson | 523/443 |
| 4,605,575 | 8/1986 | Auld et al. | 428/542.2 |
| 4,711,916 | 12/1987 | Hagiwara et al. | 523/443 |

*Primary Examiner*—Thurman K. Page
*Assistant Examiner*—Donald J. Loney
*Attorney, Agent, or Firm*—Warren H. Kintzinger

[57] ABSTRACT

An art form where earth in powdered form from specific locations—earth from a country, states, counties, a person's yard or other locations with sample records maintained is, after being heat sterilized sized to designate size range limits, and then embedded within plastic and formed to the desired shape. The shape may be a micro-dot insertable in commemorative coins or utilized in jewelry of all sizes and shapes or molded into a whole range of jewelry shapes and sizes. The plastic may be a thermo softening and setting plastic, a chemical reactive setting plastic or even a thermo setting resin such as an epoxy resin into which some of the desired powdered earth is entrained.

16 Claims, 2 Drawing Sheets

EARTH ART FORMS

This invention relates in general to art forms in plastic, and more particularly, to plastic forms with entrained earth powder within the plastic. This can take the form of plastic micro-dots insertable into packets in commemorative coins or medallions or into jewelry of all sizes and shapes. The plastic with entrained earth may be molded into all kinds of jewelry configuration art forms.

Many art forms are intrinsically appealing in the esthetic art sense being in various jewelry forms including commemorative coins and medallions. These art form keepsakes are made more meaningful when they include minute earth samples enclosed within transparent plastic with specific location earth samples being used to enhance the sense of meaningful value in the art form items. Plastic micro-dots in some instances will enclose earth samples that are a mixture of earth from each of the fifty states of the United States of America. Such microdots may be seated in a packet in a "Trace 200" commemorative coin for the 200th year anniversary of the founding of the United States of America. They may be used in a "Coin of World Peace" with micro-dots containing earths of each of the seven continents of the world. Here the earth is not mixed but appears in micro-dot mounted, respectively, in each of the seven continents of the world within the outline of their particular continents on the two faces of the coin. The "Coin of the Thirteen Colonies" uses micro-dots containing a mixture of earth from each of the original thirteen colonies. The "Constitution Coin" uses micro-dots containing a mixture of earth from all fifty states of the United States of America. The "Coin of Israeli Independence" uses micro-dots containing only earth from Israel. The "Olympic Coin" contains earth from Greece, the origin of the Olympics, and earth from Korea, the chosen site for the 1988 Olympics. Earth samples in plastic in the form of micro-dots can be mounted in money clips, key rings and other jewelry items and items of art or plastic containing earth samples may be molded in any of countless jewelry and art form other than in micro-dot forms.

It is therefore a principal object of this invention to enhance sentimental attachment to various art forms.

Another object to provide art forms that include earth samples in small particulate form entrained in plastic so as to be esthetic pleasing.

A further object is to provide commerative art forms having a sense of roots to earth with earth samples the art forms are related to.

Still another object is to provide commerative coins and medallions having powdered earth samples enclosed in plastic mounted thereon.

Features of the invention useful in accomplishing the above objects include, in earth art forms, an art form where earth in powdered form from specific locations—earth from a country, states, counties, a person's yard or other locations with sample records maintained, is, after being heat sterilized, sized to designate size range limits, and then embedded within plastic that is formed to the desired shape. The shape may be a micro-dot insertable in commemorative coins or utilized in jewelry of all sizes and shapes or molded into a whole range of jewelry shapes and sizes. The plastic may be a thermo softening and setting plastic, a chemical reactive setting plastic or even a thermo setting resin such as an epoxy resin into which some of the desired powdered earth is entrained.

A specific embodiment representing what is presently regarded as the best mode of carrying out the invention is illustrated in the accompanying drawings.

Figure 1:
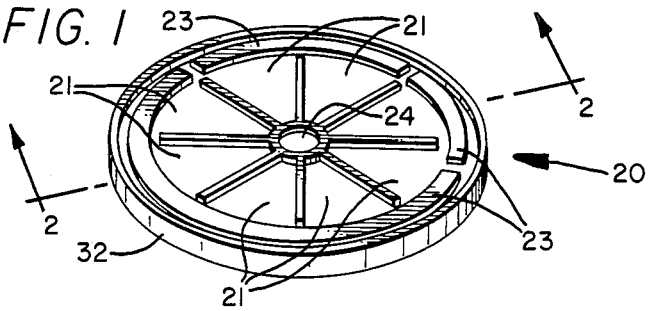
FIG. 1 represents a perspective view showing a face of a commemorative coin including a center pocket for holding a micro-dot of plastic with powdered earth entrained therein.
Figure 2:
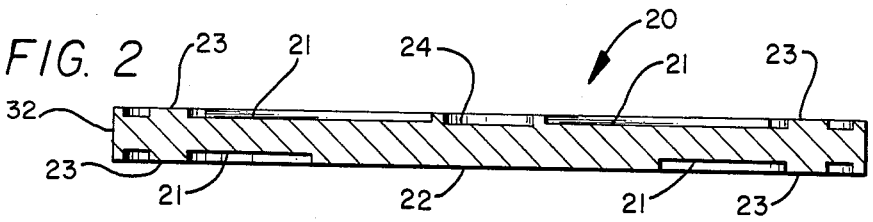
FIG. 2 is a cross sectioned view of the coin taken along line 2—2 of FIG. 1 showing further detail of the coin.
Figure 3A:
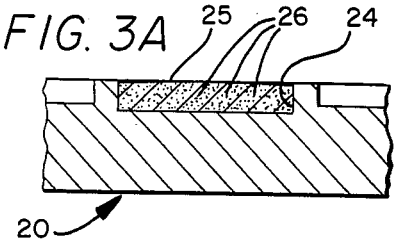
Figure 3B:
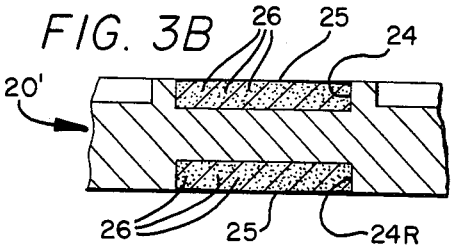
Figure 3C:
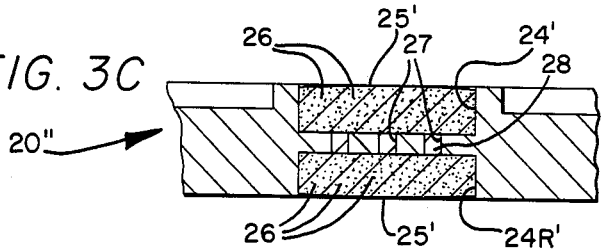
Figure 4:
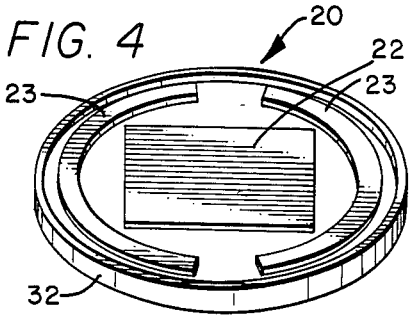
Figure 5:
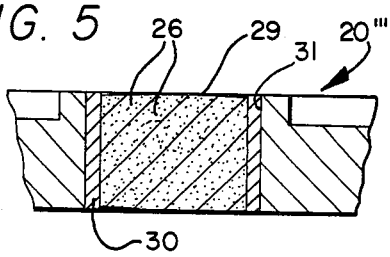
Figure 6:
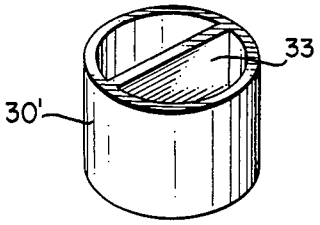
Figure 8:
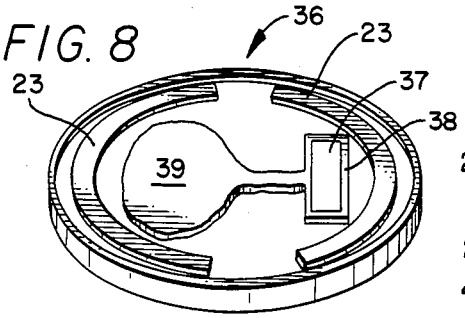
Figure 9:
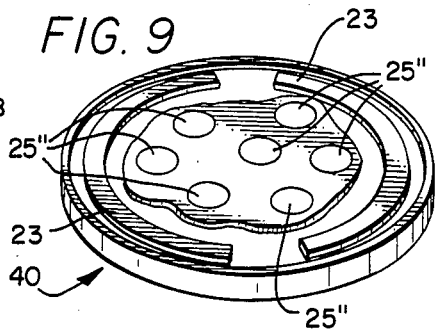
Figure 9A:
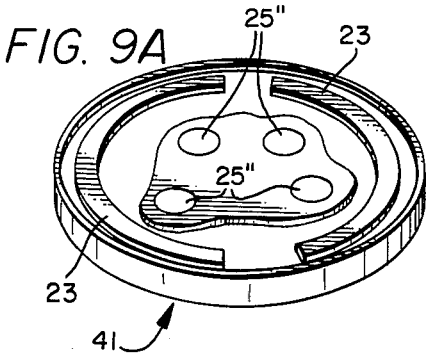
Figure 9B:
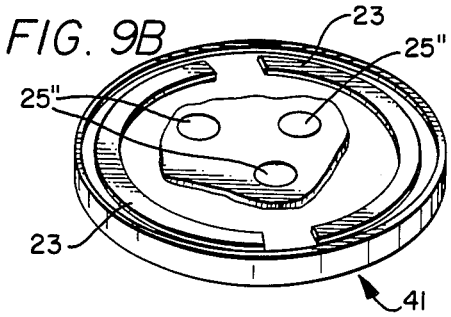
Figure 11:
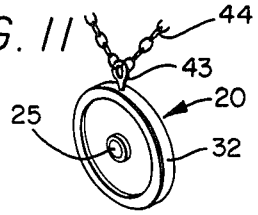
Figure 10:
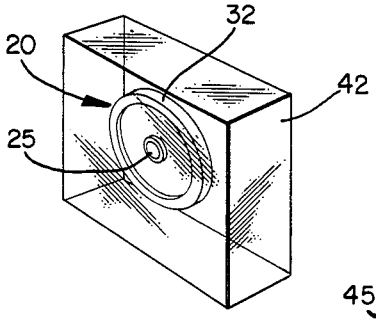

FIG. 3A, a partially cut away and enlarged section view of a a plastic micro-dot containing center pocket portion of the coin of FIG. 1 and 2;

FIG. 3B, a partially cut away and sectioned view like that of FIG. 3A of a coin having micro-dot containing center pockets on opposite sides thereof;

FIG. 3C, a partially cut away and sectioned view like that of 3B with with clear plastic filled openings interconnecting the bottom of the micro-dot in the center pocket in the other side face of the coin;

FIG. 4, a perspective view of the opposite face of the commemorative coin of FIG. 1;

FIG. 5, a partially cut away and sectioned view of a coin portion with a through hole containing a through plug of plastic with entrained powdered earth;

FIG. 6, a plastic plug mount member with a side to side reinforcing wall;

FIG. 8, a perspective view of another commemorative coin with a tree symbolically growing out of a plaque of plastic with entrained earth;

FIG. 9, a perspective view of a commemorative coin with a plurality of plastic micro-dots mounted on one side;

FIGS. 9A and 9B, are perspective views of the opposite sides of a commemorative coin with coin plastic micro-dots mounted in pockets on one side and three plastic micro-dots mounted in pockets on the other side of the coin;

FIG. 10, a perspective view of a commemorative coin mounting a section of plastic with entrained powdered earth encased in a transparent block of plastic such as lucite;

FIG. 11, a perspective view of a commemorative coin with plastic entrained earth suspended on a chain.

Figure 12A:
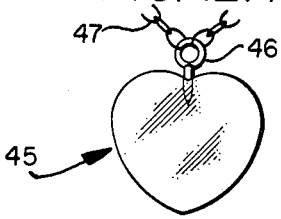

FIG. 12A, a heart shape of plastic with entrained earth; and

Figure 12B:
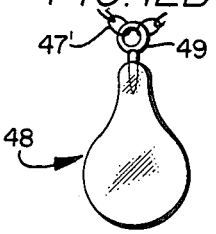

FIG. 12B, a plastic pendant with entrained earth equipped with an eyelet for a necklace chain.

Figure 7:
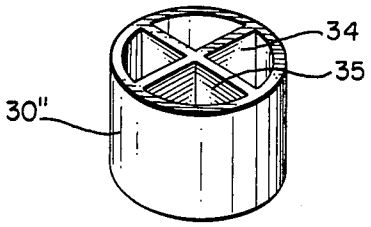

Referring to the drawings:

The commemorative coin 20 of FIGS. 1, 2, 3A and 4 is, in addition to engraved art working 21, message plaque 22, and wording strips 23, provided with a pocket24 into which a plastic micro-dot 25 is placed that contains entrained particles of earth 26. The commemorative coin 20' of FIG. 3B is shown to have plastic micro-dots 25 inserted in pockets 24 and 24R in opposite sides of the coin 20' of the center, or focal point, of each side face of the coin or medallion 20'. The coin, or medallion, 20'' of FIG. 3C is shown to have deeper pockets 24' and 24R' with plastic micro dots 25' inserted therein, and openings 27 filled with clear plastic 28 joining the pockets 24' and 24R' through a wall for some back lighting for the plastic micro-dots 25'. WIth the coin or medallion 20''' of FIG. 5 a plastic plug 29 with entrained particles of earth 26 within a mounting cylinder 30 is inserted in an opening 31 through the coin 20'''. The outer circumferential rim surface 32 of each of these coins 20, 20', 20'' and 20''' is either smooth, as shown, or flute scored. The alternate plastic plug mount member 30' of FIG. 6 is shown to have a transverse side to side reinforcing wall 33 that divides the plastic plug held thereby into two halves. The alternate plastic plug mount member 30'' of FIG. 7 is shown to have cross cross reinforcing walls 34 and 35 that divide the plastic plug held thereby into four quarters. It should be noted that the mounting cylinder 30 in some embodiments could be a cylinder of adhesive material. With the micro-dot 25 and 25' embodiments the micro-dots could be a press fit in the pockets 24 and 24', respectively, or mounted in the receiving pockets with adhesive.

The commemorative coin or medallion 36 of FIG. 8, instead of a plastic micro-dot, has a plaque 37 of plastic with entrained earth mounted in a rectangular pocket 37 and a tree 39 symbolically growing out of the plastic plaque 37.

The commemorative coin 40 of FIG. 9 is a coin with a plurality of micro-dots 25'' on one side face thereof mounted in a plurality of pockets instead of a single micro-dot at a focal point of a coin face. With the coin 41 of FIGS. 9A and 9B there are four micro-dots 25'' on one side face and three micro-dots 25'' mounted in pockets on the reverse side face.

A commemorative coin 20 is shown in FIG. 10 to be attractively mounted in a rectangular block of a clear plastic 42 such as lucite for display purposes. A commemorative coin 20 is shown in FIG. 11 to be equipped with a jewelers' eyelet 43 for suspension of the coin 20 from a chain 44.

The jewelry items of FIG. 12A and 12B are, respectively, a plastic heart shape 45, with entrained earth particles, having a jewelers' eyelet 46 for a necklace chain 47, and a plastic tear drop pendant 48, with entrained earth particles, also equipped with a jewelers' eyelet 49 for suspension from a chain.

Obviously, earth art form jeweler may be made in a great variety of shapes and sizes in providing something of history, origins, identity and/or of sentimental attachment to the holder with earth from specific locations used alone or mixed in selected combinations. While some micro-dots of plastic with entrained earth powder (or particles) may be approximately one eighth to one quarter inch in diameter and ten to forty five thousandths of an inch thick may contain, typically, some six-thirty thousandths particles of earth. This insures, for example, if the earth samples from fifty states were mixed together thoroughly that each microdot has an extremely high probability of having therein some earth from from each and every one of the states. On the other extreme if a sample is to be of one specific location the earth sample embedded in plastic could be as low as one particle, but as a practical matter would probably run into hundreds of particles if not thousands.

A "micro-dot" of plastic containing earth samples could be to earth samples from the fifty states of America, in some earth of the original thirteen colonies of America, Delaware, Pennsylvania, New Jersey, Georgia, Connecticut, Massachusetts, Maryland, South Carolina, New Hampshire, Virginia, New York, North Carolina, and Rhode Island; in some instances, such as with a Coin of Prayer, the seven continents of the world, Asia, Africa, Australia-Oceania, North America, South American Europe and Antarctica.

In each such instance, a laboratory is to go through the same steps to identify and to complete the process of creating the end product from the raw earth that they first accumulate such as the following:

1. Design and specify the documentation requirements covering the certification of the sample location, packaging and shipment of soil to the main laboratory.

2. Maintain records for internal control of soil samples received, processed and shipped. The records will be kept on file for a period of seven years unless a longer period is required and the laboratory is informed in writing.

3. The soil received will be dried at 320° Farenheit for a minimum of 4 hours for sterilization.

4. All soil will be dried and sized into three lots, as required, and blended, they will be referred to as "Coarse" material greater than a #16 sieve, "Random" material between #16 and #120 sieve, and "Preferred" material passing a #120 sieve.

5. The "Preferred Sample", 50 state blend: No more than 3 pounds, 4 ounces nor less than 3 pounds of soil will be blended from each state. Upon completion of the blend of soil from all 50 states, 10% silica sand by weight will be introduced and the total mixture blended.

6. The "State Random Sample", (Not mixed with soil from other states): No more than 15 pounds, 8 ounces nor less than 15 pounds represent a final sample per state. 25% silica sand by weight will be blended into each soil sample making the sample weight approximately 19 pounds.

7. The "Random" sample (mixed with soil from all states): Any average from the state random samples and the preferred samples will be blended, and to that weight, 15% silica sand by weight will be introduced and blended. The materials are never discarded. This sample will be generated when the supply of random sample from each state becomes less than 15 pounds.

The amount actually included from each state will be as much as "almost 15 pounds, and as little as nothing. The minimal amount from any one state to be called a 50-state mixture would be 7.5 pounds of the maximum from any one state (15) pounds.

8. The "Coarse" (this is not mixed with soil from the other states): This material is placed in a plastic cylinder bag by the laboratory and tagged. No other sizing or blending will be done with these samples.

9. The laboratory will inspect this, package, seal and ship the samples of the soil as directed.

10. Each shipment will be accompanied by a certification of the soil origin and identified.

This is the work done by the laboratory in preparing the soil to create "Trace 200", the Good Earth of America. As stated before, each of the various adaptions of the micro-dot will vary according to the ultimate use of the material. A major coin the "Constitution Coin" carries the earth of each of the fifty states.

There are countless products in which the micro-dot could be included; however, the application could use the slogan "Hold History In Your Hand" with it put into products which ore of (a) historic content value, (b) could be applied to the fifty states of America, (c) will be able to be held in the hand or hands; in other words, nothing that is large would be used. Now, the products which use earth from a specific state would follow the same historic theme, and would be hand held, but would only use earth from a specific state or area. If the micro-dot of earth of all continents is used, the same would apply, and if the earth from a particular nation would be used this would also apply.

Whereas this invention has been described with respect to several embodiments thereof, it should be realized that various changes may be made without departure from the essential contributions to the art made by the teachings thereof.

I claim:

1. An earth art form comprising: plastic that becomes hardened from a fluid pliable state; and earth in particled form inserted into said plastic when in the fluid pliable state being entrained in said plastic in the hardened state; wherein said plastic with entrained particled earth is molded into shaped micro-dots and mounted in pockets on commemorative coin faces.

2. The earth art form of claim 1, wherein said micro-dots are a press fit in pockets on commemorative coin faces.

3. The earth art form of claim 1, wherein said micro-dots are mounted in place in said pockets on said commemorative coin faces with adhesive.

4. The earth art form of claim 1, wherein said micro-dots of particled earth entrained plastic are sized in the approximate range of one-eighth to one-quarter inch diameter and approximately ten thousandths to forty five thousandths of an inch thick; with earth particles in the six thousand to thirty thousand particle approximate range entrained in a microdot.

5. The earth art form of claim 4, wherein a micro-dot is mounted at a focal point of a commemorative coin face.

6. The earth art form of claim 4, wherein a micro-dot is mounted in pockets on both faces of a commemorative coin.

7. The earth art form of claim 6, wherein said micro-dot mounted in said pocket on said faces of said commemorative coin are in spaced aligned relation one to the other.

8. The earth art form of claim 7, wherein opening means through a wall extends between adjacent inner ends of micro-dots in spaced aligned relation in said commemorative coin.

9. The earth art form of claim 8, wherein clear plastic contained in said opening means facilitates mutual back lighting for said spaced aligned micro-dots.

10. The earth art form of claim 4, wherein a micro-dot is mounted at the center of a commemorative coin face.

11. The earth art form of claim 1, wherein said plastic is a transparent plastic with entrained particled earth visible to the eye.

12. An earth art form comprising: plastic that becomes hardened from a fluid pliable state; and earth in particled form inserted into said plastic when in the fluid pliable state being entrained in said plastic in the hardened state; wherein said plastic with entrained particled earth is in the form of plastic plug means mounted in an opening extending through a commemorative coin between opposite side coin faces.

13. The earth art form of claim 12, wherein said plastic plug means is held in a mounting cylinder inserted in said opening through a commemorative coin.

14. The earth art form of claim 13, wherein said mounting cylinder is provided with side to side reinforcing means.

15. The earth art form of claim 14, wherein side to side reinforcing means divides said plastic plug means into a plurality of plastic plug sections.

16. An earth art form comprising: plastic that becomes hardened from a fluid state; and earth in particled form inserted into said plastic when in the fluid pliable state being entrained in said plastic in the hardened state; wherein said plastic with entrained particled earth is molded to a rectangular shape and mounted in rectangular pockets on commemorative coin faces.

* * * * *